United States Patent [19]

MacKenzie

[11] Patent Number: 4,515,993

[45] Date of Patent: May 7, 1985

[54] LOW PROFILE SUBMERSIBLE ELECTRICAL CABLE

[75] Inventor: Burton T. MacKenzie, Lawrence, Kans.

[73] Assignee: TRW Inc., Cleveland, Ohio

[21] Appl. No.: 571,315

[22] Filed: Jan. 16, 1984

[51] Int. Cl.[3] ..... H01B 7/18; H01B 7/28

[52] U.S. Cl. ..... 174/102 R; 174/117 F; 174/120 SR; 174/121 SR

[58] Field of Search ..... 174/102 R, 110 FC, 110 N, 174/120 SR, 121 SR, 121 A, 124 G, 117 R, 117 F

[56] References Cited

U.S. PATENT DOCUMENTS

| | | | |
|---|---|---|---|
| 2,606,134 | 8/1952 | Sanders | 174/110 FC |
| 2,691,694 | 10/1954 | Young | 174/110 FC |
| 3,408,453 | 10/1968 | Shelton, Jr. | 174/110 FC |
| 3,616,177 | 10/1971 | Gumerman | 174/110 FC X |
| 3,809,802 | 5/1974 | Pearson | 174/103 |
| 4,051,324 | 9/1977 | Anderson et al. | 174/121 A X |
| 4,088,830 | 5/1978 | Wargin et al. | 174/113 R |
| 4,096,351 | 6/1978 | Wargin et al. | 174/102 R |
| 4,267,098 | 5/1981 | Hartwimmer et al. | 174/110 FC X |
| 4,284,841 | 8/1981 | Tijunelis et al. | 174/103 |
| 4,319,940 | 3/1982 | Arroyo et al. | 174/110 FC X |
| 4,401,845 | 8/1983 | Odhner et al. | 174/110 FC X |

FOREIGN PATENT DOCUMENTS 2113454 8/1983 United Kingdom .

*Primary Examiner*—A. T. Grimley
*Assistant Examiner*—Morris H. Nimmo
*Attorney, Agent, or Firm*—Daniel G. Blackhurst

[57] ABSTRACT

A low profile electrical cable (10) suitable for use in an oil well where a high temperature corrosive atmosphere is present. The cable is comprised of a plurality of conductors (12) wherein each conductor is insulated by wrapping it in two heat-sealed layers (14) in an insulating material such as a polyimide plastic. The insulation layers around each conductor are then jacketed by an extruder layer (16) of a material which is mechanically and chemically stable to at least 400° F. The insulated and jacketed conductors are disposed in a side-by-side parallel relationship and wrapped in a metal armor (20) such as a nickel-copper alloy. The physical properties of the insulating and jacketing materials allow very thin layers to be used for producing a cable which is smaller in overall dimensions than prior cables of comparable electrical capacity. Optionally, a braid (18) may be included around the jacket (16) of each conductor to enhance the overall strength characteristics of the cable.

11 Claims, 1 Drawing Figure

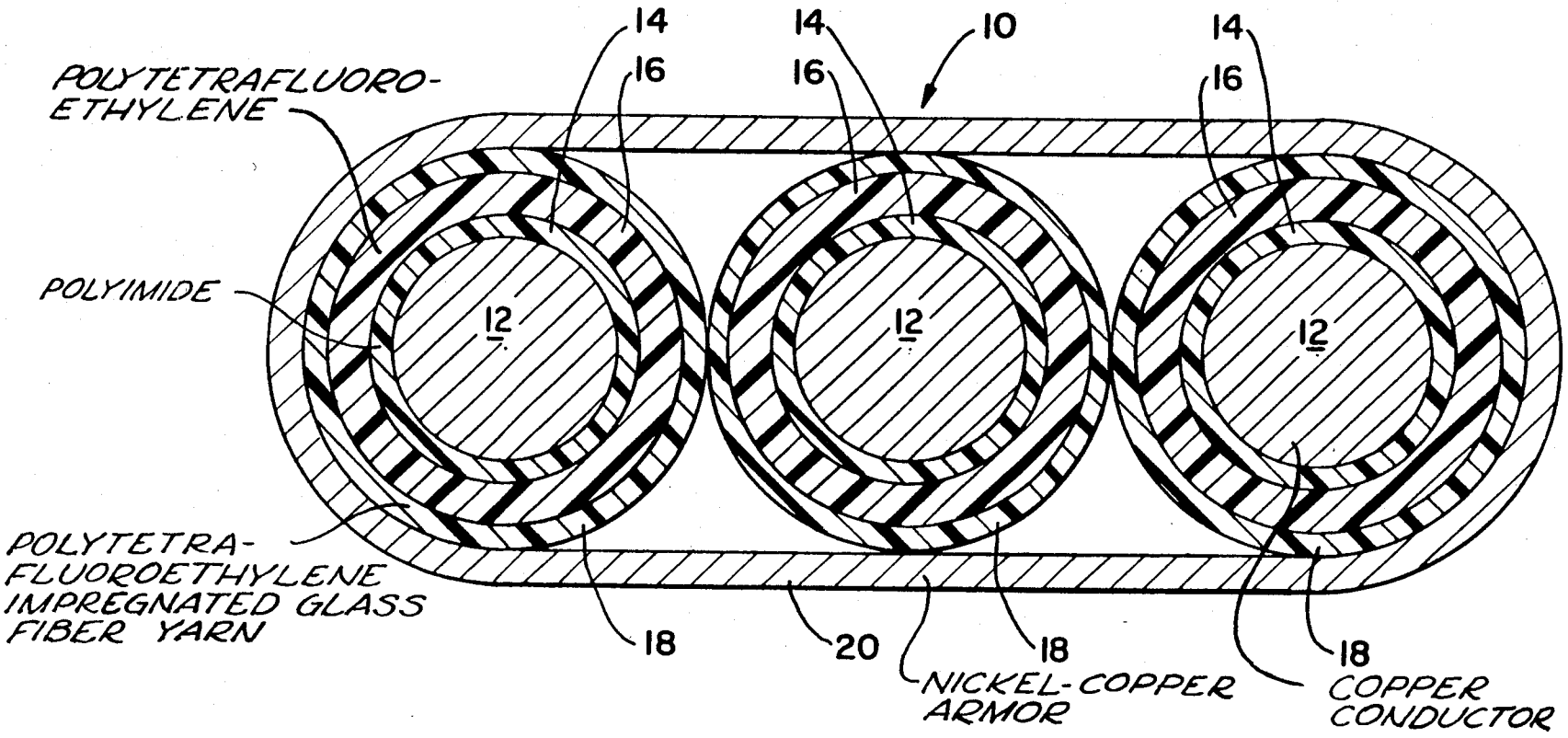
10
12
14
16
18
20
COPPER CONDUCTOR
NICKEL-COPPER ARMOR
POLYTETRAFLUORO-ETHYLENE
POLYIMIDE
POLYTETRA-FLUOROETHYLENE IMPREGNATED GLASS FIBER YARN

LOW PROFILE SUBMERSIBLE ELECTRICAL CABLE

BACKGROUND OF THE INVENTION

The present invention relates to the art of electrical cables and, in particular, to an electrical cable having small overall dimensions suitable for use in small diameter oil wells where the atmosphere is at elevated temperatures and pressures, and is corrosive. It will be appreciated, however, that the invention has broader applications and may be adapted to other cable applications and uses.

Prior art oil well cables have been designed for use in corrosive, high temperature, and high pressure conditions. Such cables are typically formed with a plurality of conductors, each of which is surrounded by a polymeric insulating material such as an ethylenepropylene-diene monomer terpolymer (EPDM). EPDM comprises an elastomer rubber which is permeable by gases in the well. Pressure changes experienced by the cable as it is thereafter removed from a well cause the EPDM material to enlarge or swell. Thus, a braid overwrap has also been provided in the prior art to prevent rupture of the EPDM as a result of swelling. An alternative to wrapping a braid around EPDM insulation to restrain swelling is to encase the insulated conductor in lead. This prevents well gases from reaching the EPDM. Either the lead encased or braid-wrapped conductors may also include an outer wrap of metal or plastic armor. Examples of cables embodying these concepts are shown in U.S. Pat. Nos. 3,809,802; 4,088,830; 4,096,351; and, 4,284,841.

Cables used in an oil well type environment are subject not only to chemical attack, but also to mechanical abuse from being installed into and removed from the well itself. Although the lead sheathed cables are not as vulnerable to chemical attack as braid-wrapped cables, the weight of the lead renders mechanical failure far more likely. Moreover, handling of lead sheathed cables is difficult. While cables having EPDM with a braid overwrap are generally lighter in weight than the lead sheathed cables, they are also quite bulky. This situation can present a problem when the cable is to be used in a "tight hole" application, i.e., a well of relatively small diameter.

It has, therefore, been considered desirable to develop a new submersible electrical cable construction. The subject invention is directed to such development which overcomes the foregoing problems and others, and which is deemed to better meet the needs of the industry.

SUMMARY OF THE INVENTION

The present invention provides an electrical cable particularly adapted for use in applications involving high temperatures (up to 400° F.) and corrosive atmospheres (e.g., brine and hydrogen sulfide gases). In general, the cable is comprised of a plurality of conductors insulated with at least one layer of plastic insulating material having a high dielectric strength and jacketed with a layer of protective material. The insulated and jacketed conductors are thereafter wrapped in a protective metal armor.

According to a more limited aspect of the invention, a braid structure may be included about each conductor on the outside of the protective material.

According to the preferred construction, the insulating material comprises a polyimide plastic and the protective material comprises a polymeric material. A polytetrafluorethylene-perfluoroalkoxy or a polyetheretherketone polymer is particularly desirable.

Also according to the preferred construction, the insulating material is applied in tape form to include a double wrap. After application, the tape is heat sealed. Still further, the polytetrafluoroethylene is extruded onto the conductors.

The principal focus of the invention is the provision of a new, improved construction for a submersible electrical cable.

One advantage of the invention resides in the provision of such a cable which has low profile characteristics and may be used in tight hole applications.

Another advantage is in the provision of a submersible electrical cable which is unaffected by high temperatures, is resistant to chemically corrosive environments, and has strong mechanical characteristics.

Still other advantages will become apparent to those skilled in the art upon a reading and understanding of the following detailed description.

BRIEF DESCRIPTION OF THE DRAWING

The invention may take physical form in certain parts and arrangements of parts, a preferred embodiment of which will be described in detail in this specification and illustrated in the accompanying drawing which forms a part hereof and wherein the FIGURE illustrates a cross-sectional view of an electrical cable constructed in accordance with the present invention.

DESCRIPTION OF PREFERRED EMBODIMENT

Referring now to the drawing wherein the showings are for purposes of illustrating the preferred embodiment of the invention only and not for purposes of limiting same, the electrical cable generally designated 10 is adapted to carry electric current to motors and/or other electrically operated apparatus located deep in an oil well. In such an environment, the ambient conditions include corrosive chemicals at high temperatures and pressures. Specifically, cable 10 is adapted for use at temperatures ranging up to approximately 400° F. in an environment having brine and hydrogen sulfide gases along with other corrosive compounds.

In the preferred embodiment illustrated, cable 10 includes three parallel, identical conductors 12. In one typical construction, each of conductors 12 comprises a No. 6 solid copper wire; however, it will be appreciated that a greater or lesser number of conductors, or conductors constructed of different materials and/or sizes may be suitably employed. Such modifications are not deemed to in any way depart from the overall intent or scope of the invention.

Each conductor 12 is first closely surrounded with an insulation 14 having a high dielectric strength and which does not break down at elevated temperatures. In the preferred construction, a polyimide plastic such as the one manufactured by E. I. du Pont de Nemours & Company under the trademark KAPTON is advantageously employed. The polyimide plastic is preferrably applied as a heat-sealed double wrap of tape with the individual wraps being approximately 50–55 percent overlapped, and wherein such overlap may be either parallel or reversed. This material has a dielectric strength in excess of 5000 volts/mil., and does not break down even at 500° F. After wrapping, the tape is heat sealed by convenient, known means. The preferred material used is marketed under the designation KAPTON 200; however, it may be possible to insulate conductors 12 with other plastic materials having substantially similar physical characteristics.

A coating or jacket 16 is then placed in a close surrounding relationship with insulation 14 of each conductor 12. For practicing the subject invention, jacket material 16 must comprise a high temperature, chemically and mechanically stable material. In the embodiment here under consideration, jacket 16 comprises a fluorinated hydrocarbon polymeric material, with a material comprising a backbone of fluorocarbons with perfluoroalkoxy side chains being preferred. One such material which has been found suitable is available from E. I. du Pont de Nemours & Company under the trade designation TEFLON 340 PFA. Other suitable materials include polyetheretherketone which is an aromatic polyether marketed by Imperial Chemical Industries Limited under the trade designation PEEK, or other fluorinated polymers with mechanical and chemical stability up to 400° F.

Coating or jacket 16 is applied to, preferably extruded onto, each of conductors 12. Jackets 16 constructed from the preferred material are mechanically and chemically stable up to a temperature of at least 400° F. and serve to protect insulation layers 14 from chemical corrosion as well as physical abrasion. In the preferred construction, the thickness of each jacket 16 is approximately 27 mils with a wall thickness range of approximately 25–35 mils.

Optionally, a braid 18 may be placed around each of jackets 16. If provided, the braids are applied in a close surrounding relationship with the jackets in a conventional manner. Braids 18 preferably comprise a close weave configuration of a polytetrafluoroethylene impregnated glass filament yarn or other braid materials with mechanical stability to 400° F. or higher, and provide added protection for each insulated and jacketed conductor.

As shown in the FIGURE, three conductors 12 are disposed in a parallel side-by-side relationship with each other, and closely surrounded by an overwrap of metal armor 20. In the preferred cable construction, a special wrap of a nickel-copper alloy is advantageously utilized. One such wrap is available from The International Nickel Co., Inc. under the trademark MONEL. Other suitable armors may comprise galvanized steel or bronze.

The side-by-side or parallel arrangement employed in the subject invention is especially useful in "tight hole" applications, e.g., oil wells of small diameter, where a larger, round cable would cause interference or other problems. Moreover, the nature of insulation 14 and jackets 16 allow cable 10 to be constructed to have an especially small size. For example, a cable constructed in accordance with the present invention wherein No. 6 copper wire is used for conductors 12 has a major cross-sectional dimension of approximately 0.806 inches and a minor cross-sectional dimenision of approximately 0.337 inches. This represents a very favorable improvement over prior art cables of comparable electrical capacities and heat and chemical resistance which have major and minor dimensions of approximately 0.944 and 0.392 inches, respectively. The small overall size of cable 10 permits it to be used both as a main power cable and as a motor lead.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A multi-conductor electrical cable for use in a high temperature and high pressure corrosive environment, said cable comprising:

a plurality of electrical conductors sheathed in an array of separate layers of material comprising plastic materials proximate to the conductor and including outer layers of metal, at least the first of said proximate layers comprising a plastic insulating material having a high dielectric strength closely surrounding each conductor, a second of said proximate layers comprising a polymeric material which is mechanically and chemically stable to at least 400° F. closely jacketing said first layer by being directly extruded thereon, and an outer protective metal armor surrounding said plurality of insulated and jacketed electrical conductors.

2. The electrical cable as set forth in claim 1 further including a protective braid closely surrounding each of said second layers, said braids being constructed of a material having mechanical integrity to at least 400° F.

3. The electrical cable as set forth in claim 2 wherein said protective braid material comprises a polytetrafluoroethylene impregnated glass filament yarn.

4. The electrical cable as set forth in claim 1 wherein the plastic insulating material of said first layer comprises a polyimide plastic.

5. The electrical cable as set forth in claim 4 wherein said first layer comprises a spiral wrap of said polyimide plastic material disposed along the associated conductor, the individual wraps which comprise said spiral wrap being disposed in an overlapping relationship with each other.

6. The electrical cable as set forth in claim 4 wherein said first layer comprises more than one thickness of said insulating material disposed around each of said conductors and heat sealed.

7. The electrical cable as set forth in claim 1 wherein the polymeric material of said second layer comprises a fluorinated polymer.

8. The electrical cable as set forth in claim 7 wherein said fluorinated polymer comprises polytetrafluoroethylene-perfluoroalkoxy.

9. The electrical cable as set forth in claim 1 wherein the polymeric material of said second layer comprises a polyetheretherketone polymer.

10. The electrical cable as set forth in claim 7 wherein each second layer is approximately 25–27 mils in thickness.

11. The electrical cable as set forth in claim 1 wherein said plurality of conductors are disposed in a parallel, side-by-side relationship to each other.

* * * * *